US006009048A

United States Patent [19]

Raesz

[11] Patent Number: 6,009,048

[45] Date of Patent: Dec. 28, 1999

[54] NOVELTY RADIO-ALARM CLOCK

[76] Inventor: Carole H. Raesz, 7003 Beckett Rd., Austin, Tex. 78749

[21] Appl. No.: 09/196,758

[22] Filed: Nov. 20, 1998

Related U.S. Application Data

[60] Provisional application No. 60/066,393, Nov. 24, 1997.

[51] Int. Cl.[6] ..... G04B 47/00; G04B 23/02

[52] U.S. Cl. ..... 368/10; 368/73; 368/250; 368/276; D10/6; D21/370

[58] Field of Search ..... 368/10, 72–74, 368/88, 243, 250, 257, 276, 278, 285; D10/6; D21/370

[56] References Cited

U.S. PATENT DOCUMENTS

| | | | |
|---|---|---|---|
| D. 361,516 | 8/1995 | Peersmann . | |
| D. 380,687 | 7/1997 | Hsu . | |
| 2,708,337 | 5/1955 | Leach | 365/272 |
| 3,835,640 | 9/1974 | Hughes, Jr. . | |
| 5,311,488 | 5/1994 | Trantham | 358/250 |
| 5,402,396 | 3/1995 | Jones, Jr. | 368/250 |
| 5,452,270 | 9/1995 | Ikeda et al. . | |
| 5,469,346 | 11/1995 | Haut et al. . | |
| 5,560,603 | 10/1996 | Seelig et al. . | |
| 5,584,764 | 12/1996 | Inoue . | |

*Primary Examiner*—Vit Miska
*Attorney, Agent, or Firm*—Richard C. Litman

[57] ABSTRACT

A novelty electric and digital alarm clock with or without a radio is configured as a gambling slot machine or a "one-armed bandit" and computerized to perform various functions. A lever arm on one side sets the alarm by being moved forward. The alarm clock has a red dome light on top which lights up when the preset awakening time is reached. A first display screen comprising light emitting diodes with or without light pipes, electroluminescent devices, or a liquid crystal display initially shows three different fruits in color, but shows three sevens when the alarm is initiated. One or a plurality of switches on the back of the clock permit the selection of a vocal phrase, a tune, a ringing bell or a radio program which will be activated as the alarm. The payout chute at the front and bottom of the clock displays metal or plastic coins under a transparent cover to simulate a payout chute which lights up or flashes when the alarm is activated. Four push buttons on one side of the dome light offer selections of the clock's time in hour and minute, and the setting of the alarm time. The dome light also functions as a snooze push button permitting the cancellation of the alarm for a predetermined time period before the alarm is again activated. Returning the lever arm back to a vertical position shuts off the alarm system.

19 Claims, 4 Drawing Sheets

NOVELTY RADIO-ALARM CLOCK

CROSS-REFERENCE TO RELATED APPLICATION

This application claims the benefit of U.S. Provisional Patent Application Ser. No. 60/066,393, filed Nov. 24, 1997.

BACKGROUND OF THE INVENTION

1. Field of the Invention

The present invention relates to a combination radio and alarm clock and, more particularly, to a novelty electric and digital radio-alarm clock configured as a slot machine or a "one-armed bandit". The radio portion can be omitted for a lower cost model.

2. Description of Related Art

There is a need for a novelty radio-alarm clock for those interested in a simulated "one-armed bandit" radio-alarm clock. The operation of this clock for setting the alarm requires the cocking of a lever arm and being awakened by a selection of either an audible phrase announcing a winner, a catchy tune, a ringing bell or a radio program. Furthermore, a flashing red dome light, and the illuminations of three sevens and a loaded coin payout chute would mitigate, at least somewhat, the rude awakening of one from deep slumber.

The related art describes various alarm clocks and game modules. The art of interest will be discussed in the order of perceived relevance to the present invention.

U.S. Design Pat. No. 361,516 issued on Aug. 22, 1995, to Richard F. M. Peersmann depicts an ornamental design for a clock based on a one-armed bandit gambling slot machine with windows for displaying unknown indicia and a payout slot. On the back, a door, a switch and apertures presumed to be a speaker grille are shown. The clear lack of functional details and a radio distinguish this clock.

U.S. Design Pat. No. 380,687 issued on Jul. 8, 1997, to Hsi-Pin Hsu depicts an ornamental design for a clock based on a one-armed bandit machine having on the front surface an analog clock face with hour, minute and second hands. The clock face has depicted on it a cube of nine squares with a top row of three "sevens". A payout chute has "BINGO" shown above it. The rear surface has a battery compartment, a grid for an audio source and a projecting appendage of unknown identity. Again, the clear lack of any functional details and a radio including the significantly different clock face distinguish this clock.

U.S. Pat. No. 5,560,603 issued on Oct. 1, 1996, to Mac R. Seelig et al. describes a combined slot machine (one-armed bandit) and racing game. A clock appears on the upper racing display for the purpose of timing each racing element or horse. A lower display window shows the winning trio of horses as "win, place or show". The displays can be electronic or mechanical with rotating wheels. The lever arm starts the game. A coin slot and an accessory push button for starting play are located on the front surface below the two displays. The clock is distinguishable its reliance on a slot machine for playing racing games, and is not suggestive of a radio-alarm clock.

U.S. Pat. No. 5,584,764 issued on Dec. 17, 1996, to Haruo Inoue describes a slot machine without an actuating arm on a side surface. Nine observation windows are grouped in three columns and three rows display numbers and pictures from reel bodies driven by individual drivers which are further controlled by a motor controller and a computer processing unit. The front of the main frame also has a coin slot for accepting coins, a coin saucer for payout, and a starting lever below the observation windows. The slot machine is distinguishable for its lack of any suggestion for incorporating an alarm clock and a radio.

U.S. Pat. No. 3,835,640 issued on Sep. 17, 1974, to Alexander W. Hughes, Jr. describes a talking alarm clock and a method of awakening a user. A bugle replica having a clock sounds off an alarm by generating an audible rendition of the tune reveille. The wind-up alarm clock system contains essentially a digital memory containing the tune, which digital signals when energized are converted to analog signals which are further converted to audio frequency signals to be emitted by an audio speaker. The tune is reproduced from a record by the engagement of a transducer needle with a diaphragm. This clock is distinguish-able for the lack of a radio, and its reliance on a record for audible sounds and on a conventional clock face.

U.S. Pat. No. 5,452,270 issued on Sep. 19, 1995, to Hidetsugu Ikeda et al. describes a melody alarm timepiece assumed to be a watch. Twelve melodies are played on the hour and automatically reset if discordant. A printed circuit board with a timepiece circuit controls the playing of the melodies by a speaker system. The timepiece is distinguishable for its music playing watch and the lack of a radio.

U.S. Pat. No. 5,469,346 issued on Nov. 21, 1995, to Paul R. Haut et al. describes a time settable flashing light consisting of a small electronic clock, a light and a battery. The flashlight shaped casing consists of two main parts which enable the setting of the flashing light by extending the bottom end to expose the lens. Closing the telescopic slider stops the flashing of the light. The device is distinguishable as a device dissimilar in structure and function to the present invention.

The disclosures of the relevant art pertaining to the details of the mechanisms of the clock and audio systems are hereby incorporated by reference.

None of the above inventions and patents, taken either singly or in combination, is seen to describe the instant invention as claimed.

SUMMARY OF THE INVENTION

The present invention relates to a novelty electric and digital radio and alarm clock configured as a slot machine or "one-armed bandit", and the radio-alarm clock is computerized to perform various functions. An arm on one side sets the alarm by pulling the arm forward. The radio-alarm clock has a red dome light on top which energizes a light emitting diode inside when the preset wake up time is reached. The red light can be a constant or intermittent illumination. A first illuminated screen initially shows three different fruits in color, but shows three number sevens when the alarm is initiated. The screens are illuminated by either (1) LED's with or without light pipes, (2) electroluminescent devices, or (3) a liquid crystal display (LCD).

A plurality of aligned switches on the back of the radio-alarm clock permit the selection of either a vocal phrase, a tune, a bell ring, or a radio which acts as the alarm. Alternatively, a single four-way switch can be utilized. The payout chute at the front and bottom of the clock displays coins under a transparent cover which lights up when the alarm is activated. Hour and minute selections for the clock and setting the alarm are made by push buttons on the top of the radio-alarm clock on the left side of the dome light. The alarm is shut off by pushing the arm back to its upright position.

A conventional snooze alarm can be activated by pushing down on the red dome light, which also acts as a snooze alarm button, to shut off the alarm temporarily before being activated again automatically after a predetermined time period.

Accordingly, it is a principal object of the present invention to provide a computerized novelty radio-alarm clock.

It is another object of the invention to provide a novelty radio-alarm clock configured as a slot machine with an arm for setting the alarm system with three figures of fruits shown on a first liquid crystal display or an LED panel.

It is a further object of the invention to provide a novelty radio-alarm clock which lights a red dome light at the preset wake up time and can activate a snooze or delayed alarm by pushing down on the dome light.

Still another object of the invention is to provide a novelty radio-alarm clock which shows three number sevens on a first or upper liquid crystal display or LED panel or screen at the preset awakening time.

Yet another object of the invention is to provide a novelty radio-alarm clock which plays a selected audio announcement, music, a ringing bell or turns on the AM-FM radio at the preset time for awakening.

A further object of the invention is to provide a novelty radio-alarm clock which illuminates the coins in a payout slot or chute.

Another object of the invention is to provide a novelty radio-alarm clock with a second liquid crystal display or an LED panel for showing the time.

A still another object of the invention is to provide a novelty alarm clock without a radio.

A final object of the invention is to provide a snooze alarm for the novelty alarm clock with or without a radio.

It is an object of the invention to provide improved elements and arrangements thereof in an apparatus for the purposes described which is inexpensive, dependable and fully effective in accomplish-ing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
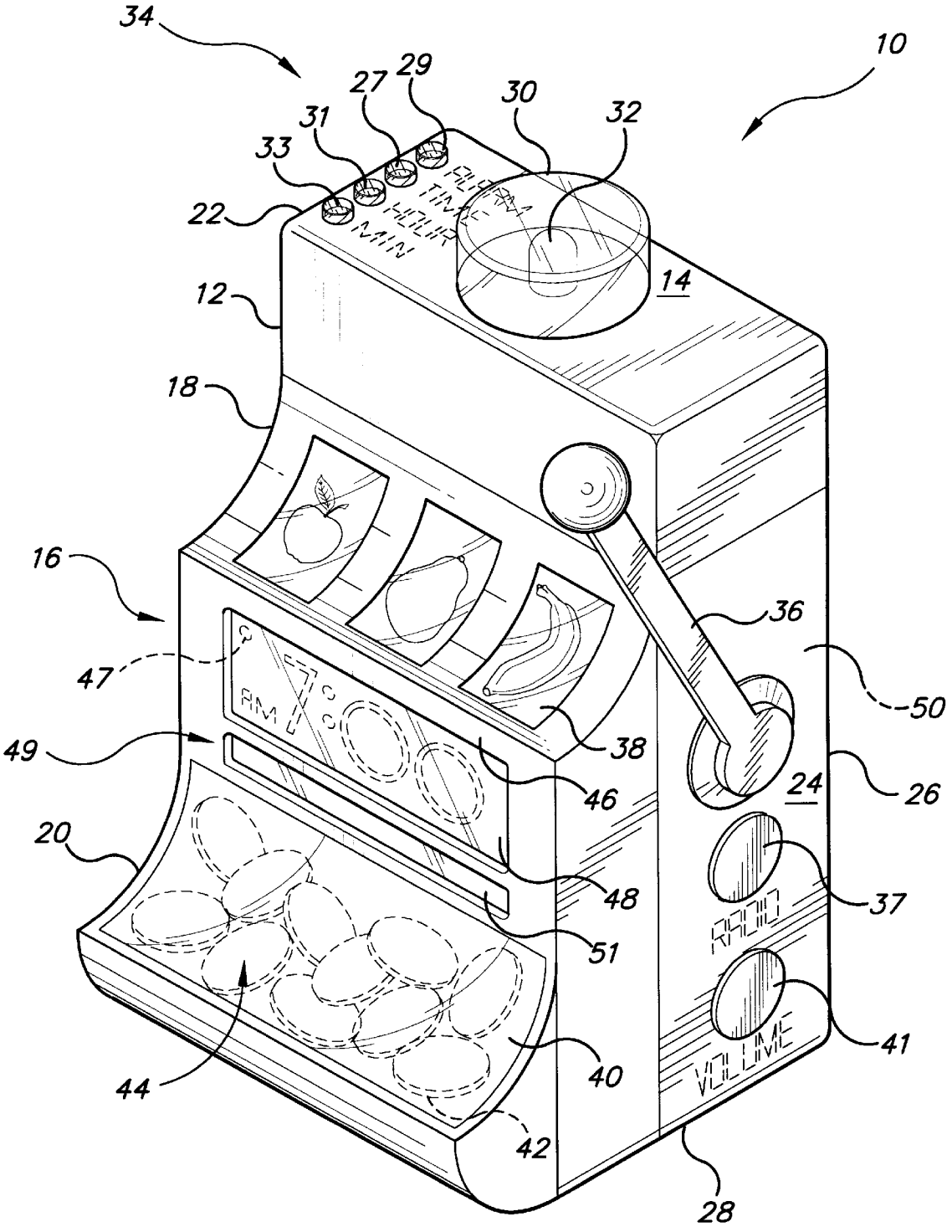
FIG. 1 is a perspective view of the novelty radio-alarm clock with the arm cocked forward with the alarm set.
Figure 2:
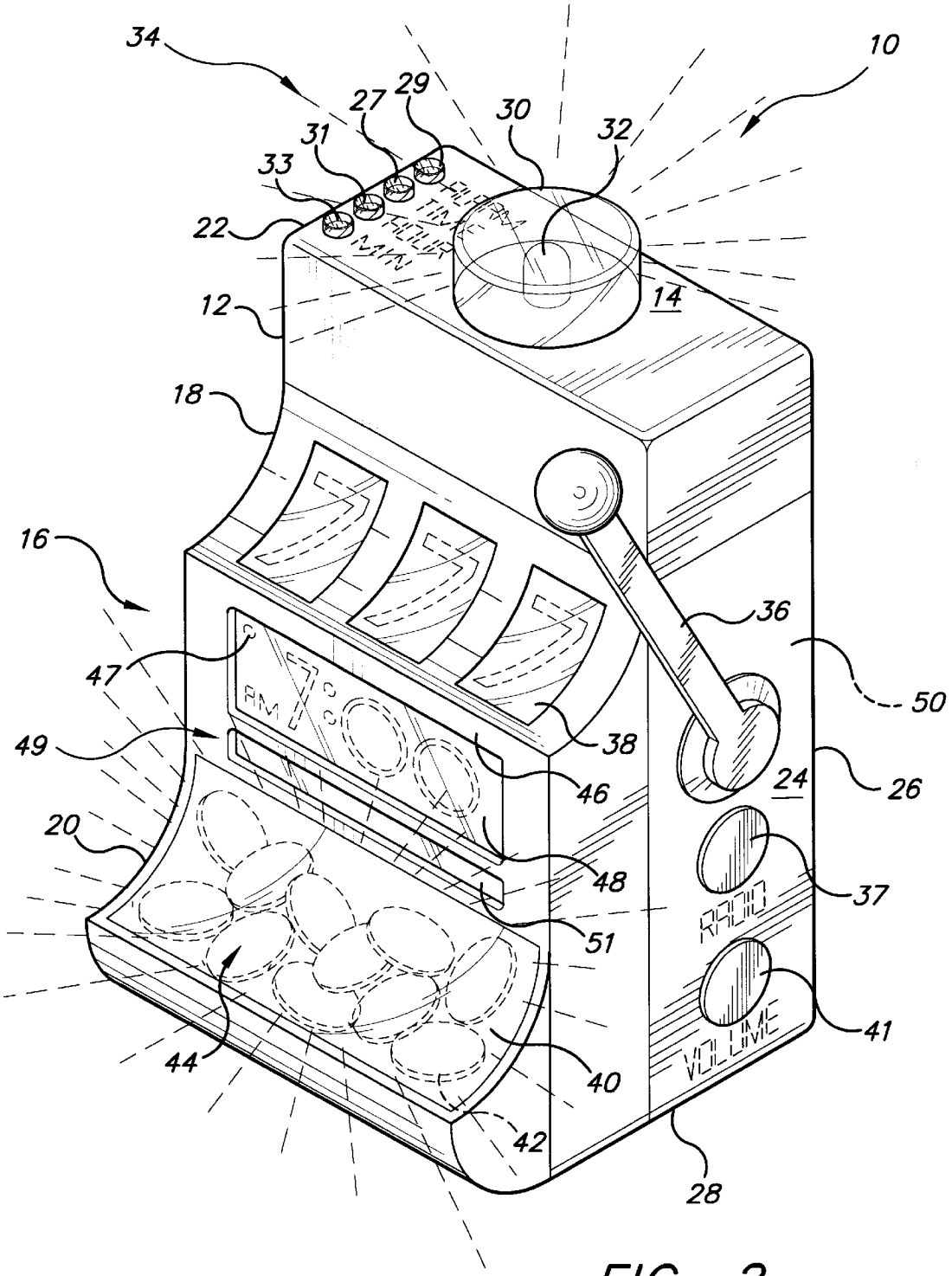
FIG. 2 is a perspective view of the novelty radio-alarm clock with the alarm activated.
Figure 3:
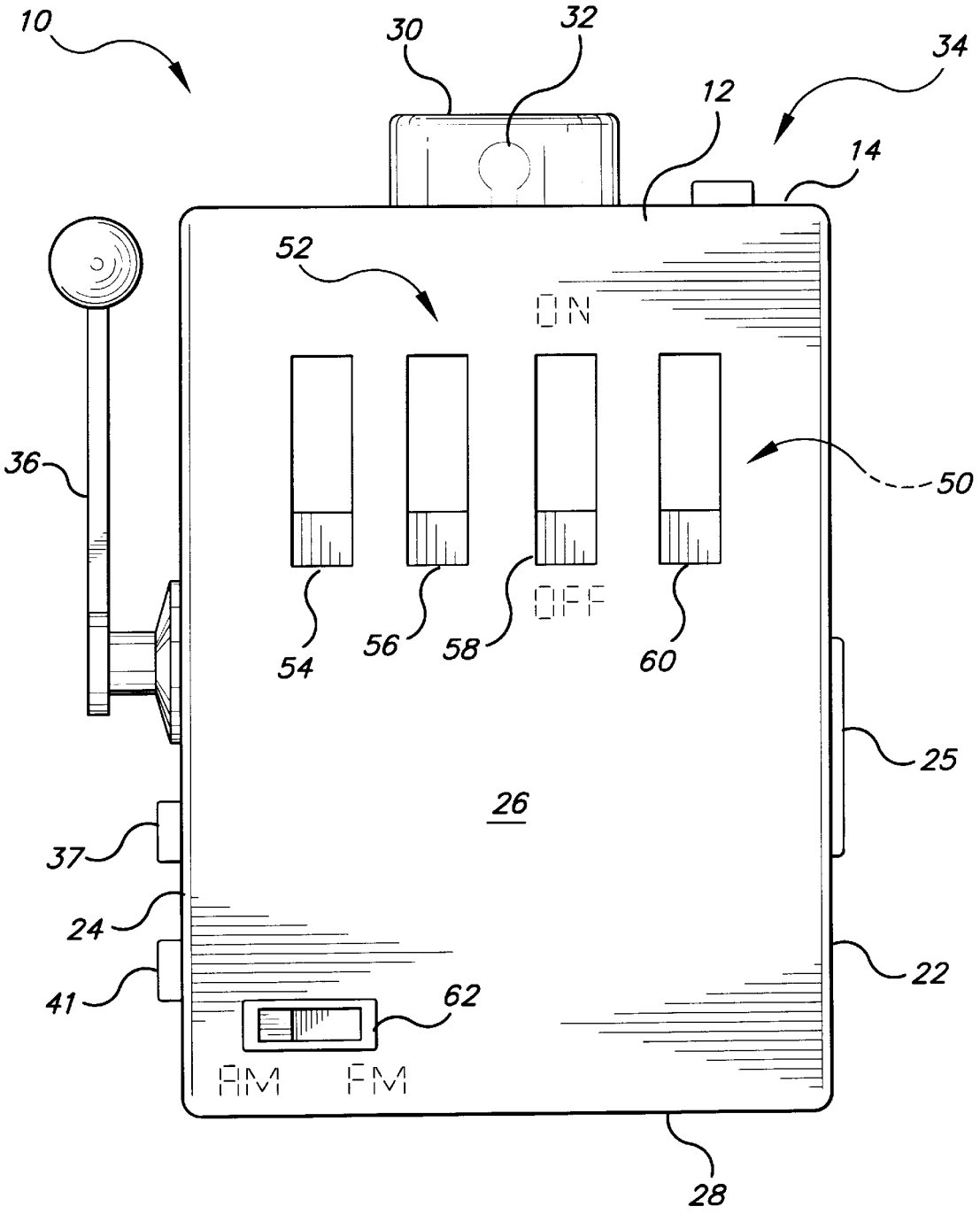
FIG. 3 is a rear view of the novelty radio-alarm clock showing slide button switches for selecting different audible awakening selections including a winner phrase, a tune, a bell ring, and a radio (AM or FM) program.

FIGS. 1 to 3 illustrate a novelty radio-alarm clock 10 having a substantially rectangular case or casing 12 with a flat top surface 14, an irregular front surface 16 having a first upper concave shoulder 18 and a second lower concave shoulder 20, a flat left side surface 22, a flat right side surface 24, a flat rear surface 26, and a flat bottom surface 28.

On the top surface 14, a cylindrical plastic dome light 30, preferably red, including a light emitting diode (LED) 32 is centrally located. The dome light 30 has another function other than lighting up with the alarm mode. The dome light 30 can by pushed down to activate a snooze mode which permits the alarm and all the attendant functions to abate for a predetermined limited time period. The alarm is shut off by pushing an elongated lever arm 36 back to its original upright position. Four push button switches 34 for setting the time 27, the hour 31, the minute 33, and the alarm 29 are located on the left side of the dome light 30 on the top surface 14. A speaker grill 25 is located on the left side surface 22 as shown in FIG. 3. A radio or tuner knob 37 for selecting a specific radio station and a radio volume knob 41 are located on the right side surface 24.

An elongated lever arm 36 ending in a ball is positioned vertically on the right side surface 24, and moved forward (rotated counterclockwise) to an angle of approximately 45° to set and program the alarm. The upper concave shoulder 18 located proximate the flat top surface 14 contains either (in the order of preference) a first LED display screen with or without light pipes, an electroluminescent display screen, or a liquid crystal display (LCD) screen adapted for display of colored fruits 38 (FIG. 1) and sevens 39 (shown in shadow in FIG. 2) in sets of three images. When the alarm is not activated, fruits 38 are in view until after the alarm is activated.

A second concave shoulder 20 includes a transparent display cover 40 behind which a display of fixed plastic or metal coins 42 (shown in shadow) simulates a payout chute 44. The illumination is provided by another set of LED's or other electroluminescent devices. The illumination can be muted when the clock is not in the alarm state and increased or flashing during the alarm state.

The flat surface 46 located between said first and second curved shoulders 18, 20 contains an electroluminescent clock or a liquid crystal display clock 48 as a second display screen adapted for display of current time in digital hours and minutes, and for day or evening time (shown in shadow in FIGS. 1 and 2). An additional feature is the illumination of a red dot 47 in a corner of the face of the clock 48 to indicate that the alarm has been set for a specific time.

An audible phrase means 50 and an AM-FM radio means 49 (FIG. 2) are located within the case 12. The radio panel 51 located below the clock 48 is conventionally calibrated to display the AM-FM frequencies in a linear dial or digitally. It should be noted that the radio panel 51 should be dimly illuminated with the intent to minimize distraction from the slot machine features.

It is within the ambit of the present invention, as a second embodiment, to omit the radio 49 with its controls and required electroluminescent displays for those consumers who prefer a simpler and more economical novelty clock.

In FIG. 3, four slide buttons 52 for "on" and "off" of various options are positioned on the rear surface 26. A microcomputer system or chip (hidden) is located within said case 12 and controls the selected options. The microcomputer system or the clock's integrated circuit (IC) 76 (FIG. 4) is energized by an electrical system located within said case 12 such as a 3 volt battery or alternatively connected to an external electrical cord (not shown) for plugging into an electrical power source. Also, one control means, i.e., a single slide button 52, can be employed instead for selecting a specific audible piece from the audible phrase selection means 50 by having four positions (not shown).

Phrase selector switch 54 selects a wake up phrase from the audible phrase selection means 50 within the case 12 such as "You're a winner!". The phrase is repeated until the alarm is shut off by moving the arm 36 back to the vertical position.

The tune selector switch 56 when set would result in an alarm of a pleasant musical piece such as a contemporary song being heard. The bell ring selector switch 58 would cause ringing of a bell. The radio alarm switch 60 would cause the radio to sound at the selected AM or FM station. A separate AM-FM frequency selection switch 62 is provided in the lower left side corner of the rear surface 26.

The radio-alarm clock 10 is set for a predetermined time for the alarm by initially cocking the arm 36 (FIG. 1), and selecting a specific awakening time by utilizing the alarm, hour and minute push buttons 29, 31 and 33, respectively. One specific audible option is selected by pushing up one of the slide buttons 52 to the "on" position, or slide the four-position switch to the desire audible alarm selection.

As graphically depicted in FIG. 2, the user is awakened at the predetermined time by an alarm consisting of: (1) illumination of the red dome light 30; (2) illumination of the first or upper display screen, electroluminescent display, or LED 38 with three sevens; (3) the illumination of the payout chute 44 to show the coins 42; and (4) the selected aforementioned audible alarm option being activated.

To turn off the set alarm, one needs to push back the lever arm 36 to the vertical position. If one wishes to sleep longer, one can conveniently push down the dome light 30 to activate the snooze means. After a suitable period predetermined by the computerized system, the alarm can be sounded again.

Figure 4:
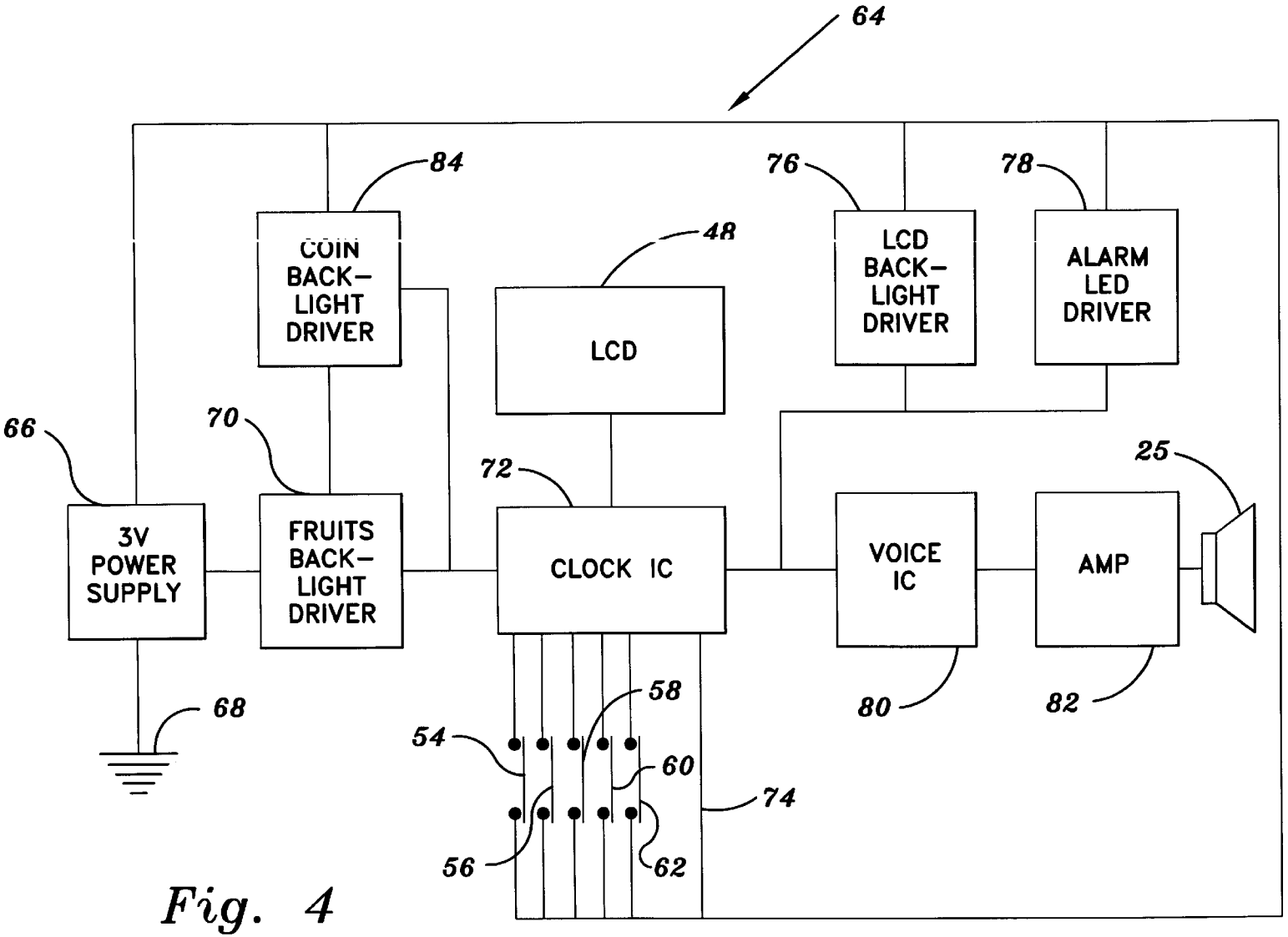
FIG. 4 is a schematic electrical circuit diagram showing the various components.

FIG. 4 is a schematic electrical circuit diagram 64 showing a 3 volt power supply 66 (battery) driving the circuit and providing the electrical power for the novelty radio-alarm clock 10. Alternatively, the power supply can be house current. A rechargeable battery can be utilized with house current means. The power supply 66 is grounded by ground 68. The current is supplied to the fruits' backlight driver element 70 and the clock IC (integrated circuit) element 72. The clock IC element 72 supplies current to the LCD or clock 48, the LCD backlight driver element 76 (radio), the alarm LED driver element 78 (dome light), the voice IC element 80, and the amplifier (AMP) element 82 (speaker grill 25). The clock IC 72 directs current back into the circuit by line 74. The switches 54 (phrase selector), 56 (tune selector), 58 (bell ring), 60 (radio alarm), and 62 (AM/FM selector) of FIG. 4. control the various specified functions. The coin backlight driver 84 is actuated by the clock IC 72 when the wake up time is reached. The coin backlight driver 84 can have a minimum illumination at other times for an artistic effect.

Thus, an economical and amusing novelty radio-alarm clock has been disclosed which would temper the rude awakening by an alarm of a typical alarm clock.

It is to be understood that the present invention is not limited to the embodiments described above, but encompasses any and all embodiments within the scope of the following claims.

I claim:

1. A novelty radio-alarm clock comprising:

a substantially rectangular case having a flat top surface, a front surface having first and second inclined concave shoulders, a flat left side surface, a flat right side surface, a flat rear surface, and a flat bottom surface;

a cylindrical plastic dome light including a light emitting diode centrally located on said flat top surface, and four push buttons for selecting the hour and minute of the clock and the alarm signals to be determined;

an elongated lever arm for setting the alarm located on said flat right side surface by cocking forward from a vertical position;

said first inclined concave shoulder located proximate said flat top surface and containing a first display screen adapted for display of number sevens or colored fruits in sets of three;

said second inclined concave shoulder located proximate said flat bottom surface and containing a transparent cover and adapted for a display of coins to simulate a payout chute;

a flat surface located between said first and second inclined concave shoulders for containing a second display screen adapted for display of current time in digital hours and minutes, day and evening time, and including an indicator dot for indicating the setting of the alarm;

an audible source means located within said case;

a control means located on said flat rear surface adapted for selection of a specific audible piece from said audible source means selected from the group consisting of a repeating congratulatory phrase, a repeating tune, a repeating ringing bell, and a radio program;

an AM-FM radio having a radio panel located between said second display screen and said payout chute;

a microcomputer system located within said case; and an electrical system located within said case connected to an external electrical cord for receiving an electrical power source; whereby said alarm clock being energized for a predetermined time for alarm by cocking said lever arm, selecting a specific awakening time by said alarm, hour and minute push buttons, selecting a specific audible piece by one slide button, and being awakened at said predetermined time by the microcomputer system, an alarm consisting of said specific audible piece, the illumination of said dome light, the illumination of said first display screen with three sevens, and the illumination of said simulated payout chute to show the coins.

2. The novelty radio-alarm clock according to claim 1, including the adaptation of said dome light as a snooze alarm push button for stopping said specific audible piece for a predetermined interval before repeating the alarm.

3. The novelty radio-alarm clock according to claim 1, wherein said first and second display screens are illuminated by a source selected from the group consisting of light emitting diodes with or without light pipes, electroluminescent devices and a liquid crystal display.

4. The novelty radio-alarm clock according to claim 1, wherein said payout chute is illuminated by a source selected from the group consisting of electroluminescent devices and light emitting diodes.

5. The novelty radio-alarm clock according to claim 1, wherein the specific audible piece from said audible source means is a repeating congratulatory phrase.

6. The novelty radio-alarm clock according to claim 1, wherein the specific audible piece from said audible source means is a repeating tune.

7. The novelty radio-alarm clock according to claim 1, wherein the specific audible piece from said audible source means is a repeating ringing bell.

8. The novelty radio-alarm clock according to claim 1, wherein the specific audible piece from said audible source means is a radio program.

9. The novelty radio-alarm clock according to claim 1, wherein the control means comprises four slide switches for the selection of the specific audible piece from said audible source means.

10. The novelty radio-alarm clock according to claim 1, wherein the control means comprises one slide switch with four positions for the selection of the specific audible piece from said audible source means.

11. A novelty alarm clock comprising:

a substantially rectangular case having a flat top surface, a front surface having first and second inclined concave shoulders, a flat left side surface, a flat right side surface, a flat rear surface, and a flat bottom surface;

a cylindrical plastic dome light including a light emitting diode centrally located on said flat top surface, and four push buttons for selecting the hour and minute of the clock and the alarm signals to be predetermined;

an elongated lever arm for setting the alarm located on said flat right side surface by cocking forward from a vertical position;

said first inclined concave shoulder located proximate said flat top surface and containing a first display screen adapted for display of number sevens or colored fruits in sets of three;

said second inclined concave shoulder located proximate said flat bottom surface and containing a transparent cover and adapted for a display of coins to simulate a payout chute;

a flat surface located between said first and second inclined concave shoulders for containing a second display screen adapted for display of current time in digital hours and minutes, day and evening time, and including an indicator dot for indicating the setting of the alarm;

an audible source means located within said case;

a control means located on said flat rear surface adapted for selection of a specific audible piece from said audible source means selected from the group consisting of a repeating congratulatory phrase, a repeating tune, and a repeating ringing bell;

a microcomputer system located within said case; and an electrical system located within said case connected to an external electrical cord for receiving an electrical power source; whereby said alarm clock being energized for a predetermined time for alarm by cocking said lever arm, selecting a specific awakening time by said hour and minute push buttons, selecting a specific audible piece by one slide button, and being awakened at said predetermined time by the microcomputer system, an alarm consisting of said specific audible piece, the illumination of said dome light, the illumination of said first display screen with three sevens, and the illumination of said simulated payout chute to show the coins.

12. The novelty alarm clock according to claim 11, including the adaptation of said dome light as a snooze alarm push button for stopping said specific audible piece for a predetermined interval before repeating the alarm.

13. The novelty alarm clock according to claim 11, wherein said first and second display screens are illuminated by a source selected from the group consisting of light emitting diodes with or without light pipes, electroluminescent devices and a liquid crystal display.

14. The novelty alarm clock according to claim 11, wherein said payout chute is illuminated by a source selected from the group consisting of electroluminescent devices and light emitting diodes.

15. The novelty alarm clock according to claim 11, wherein the specific audible piece from said audible source means is a repeating congratulatory phrase.

16. The novelty alarm clock according to claim 11, wherein the specific audible piece from said audible source means is a repeating tune.

17. The novelty alarm clock according to claim 11, wherein the specific audible piece from said audible source means is a repeating ringing bell.

18. The novelty alarm clock according to claim 11, wherein the control means comprises four slide buttons for the selection of the specific audible piece from said audible source means.

19. The novelty alarm clock according to claim 11, wherein the control means comprises one slide switch for the selection of the specific audible piece from said audible source means.

* * * * *